US006393723B1

(12) United States Patent
Nagel

(10) Patent No.: US 6,393,723 B1
(45) Date of Patent: May 28, 2002

(54) FORCED CONVECTION HEAT EXCHANGERS CAPABLE OF BEING USED IN KILNS

(75) Inventor: Robert T. Nagel, Raleigh, NC (US)

(73) Assignee: George R. Culp, New London, NC (US)

( * ) Notice: Subject to any disclaimer, the term of this patent is extended or adjusted under 35 U.S.C. 154(b) by 0 days.

(21) Appl. No.: 09/636,234

(22) Filed: Aug. 10, 2000

(51) Int. Cl.[7] ..... F26B 19/00; F26B 25/06

(52) U.S. Cl. ..... 34/201; 34/412

(58) Field of Search ..... 34/201, 191, 212, 34/390, 557, 471, 491, 307, 514, 412; 165/115

(56) References Cited

U.S. PATENT DOCUMENTS

| | | | | | |
|---|---|---|---|---|---|
| 715,070 | A | | 12/1902 | Hiorth | |
| 1,011,780 | A | | 12/1911 | Hanrahan | |
| 1,034,205 | A | | 7/1912 | Cogburn | |
| 1,293,799 | A | | 2/1919 | King | |
| 1,470,919 | A | | 10/1923 | Haas | |
| 1,471,803 | A | | 10/1923 | Parkes | |
| 1,513,639 | A | | 10/1924 | Schwartz | |
| 1,562,763 | A | | 11/1925 | Harris | |
| 1,569,302 | A | | 1/1926 | Rees et al. | |
| 1,604,074 | A | | 10/1926 | Rhoads | |
| 1,774,208 | A | | 8/1930 | Mueller | |
| 1,995,675 | A | | 3/1935 | Furbush | |
| 2,040,227 | A | | 5/1936 | Wernersson | |
| 2,422,536 | A | | 6/1947 | Finnegan | |
| 3,477,139 | A | | 11/1969 | Hildebrand | |
| 4,014,107 | A | * | 3/1977 | Bachrich | 34/191 |
| 4,098,008 | A | * | 7/1978 | Schuette et al. | 34/191 |
| 4,140,175 | A | * | 2/1979 | Darm | 165/115 |
| 4,176,464 | A | * | 12/1979 | Randolph | 34/412 |
| 4,255,870 | A | * | 3/1981 | Malmquist | 34/514 |
| 4,955,146 | A | * | 9/1990 | Bollinger | 34/191 |
| 5,226,244 | A | * | 7/1993 | Carter et al. | 34/191 |
| 5,414,944 | A | | 5/1995 | Culp et al. | |
| 5,488,785 | A | * | 2/1996 | Culp | 34/307 |
| 5,526,583 | A | * | 6/1996 | Hull et al. | 34/491 |
| 5,595,000 | A | * | 1/1997 | Goodwin, III | 34/471 |
| 5,878,509 | A | * | 3/1999 | Burnett | 34/557 |
| 6,119,364 | A | * | 9/2000 | Elder | 34/212 |
| 6,219,937 | B1 | * | 4/2001 | Culp et al. | 34/396 |

FOREIGN PATENT DOCUMENTS

| | | | | |
|---|---|---|---|---|
| DE | 29804215 | * | 6/1998 | F26B/3/20 |
| JP | 402208485 | * | 8/1990 | F26B/3/28 |
| JP | 09145252 | * | 6/1997 | F26B/23/00 |

* cited by examiner

*Primary Examiner*—Teresa Walberg
*Assistant Examiner*—Leonid M Fastovsky
(74) *Attorney, Agent, or Firm*—Alston & Bird LLP

(57) ABSTRACT

A kiln chamber has an air moving device for circulating air in the chamber interior space along a flow path, and pipe banks positioned in the chamber interior space. Each pipe bank includes finned pipes for having a heated medium flow interiorly therethrough, and each pipe bank is positioned in the flow path so that air circulated by the air moving device flows exteriorly across the finned pipes. Each finned pipe has an elongate portion having opposite ends and extending in a longitudinal direction between the opposite ends, with the longitudinal direction being at least generally perpendicular to the portion of the flow path that is proximate the finned pipe. The pipe banks are spaced apart from one another and arranged side by side with respect to one another so that a portion of the flow path extends between adjacent ones of the pipe banks. The minimum distance defined between the adjacent pipe banks is substantially greater than the minimum distance defined between adjacent finned pipes in the same pipe bank in an end elevation view of the elongate portions of the finned pipes. For each pipe bank, its finned pipes are arranged at least generally in a line in the end elevation view, and the pipe bank is arranged and any minimum distance defined between adjacent finned pipes of the pipe bank is relatively small in the end elevation view so that the adjacent pipe banks function as guide vanes for turning the flow path.

24 Claims, 5 Drawing Sheets

FORCED CONVECTION HEAT EXCHANGERS CAPABLE OF BEING USED IN KILNS

FIELD OF THE INVENTION

The present invention relates generally to forced convection heat exchangers and, more particularly, to kilns that are heated by banks of finned pipes.

BACKGROUND OF THE INVENTION

Lumber which has recently been cut contains a relatively large percentage of water and is referred to as green lumber. Prior to being used in construction or other applications which demand good grades of lumber, the green lumber must be dried. Drying removes a large amount of water from the lumber and significantly reduces the potential for the lumber to become warped or cracked.

Although lumber may be dried in the ambient air, kiln drying accelerates and provides increased control over the drying process. In kiln drying, a charge of lumber that typically consists of two or more rectangular stacks of lumber is placed in a kiln chamber. A typical kiln chamber is a generally rectangular building that can be at least partially sealed to control the amount of air that is introduced to and exhausted from the kiln chamber.

In one type of kiln, steam from a steam boiler is forced through banks of finned pipes that extend through the kiln chamber. The finned pipes heat air that is circulated within the kiln chamber by fans. The heated air flows along a flow path that extends through the charge of lumber. Conventional kilns and other types of drying apparatus that include heated pipes for heating a flow of air are disclosed in U.S. Pat. Nos. 1,513,639; 1,562,763; 1,774,208; 1,995,675 and 3,477,139. It is conventional for the pipes to be uniformly arranged so that they cause large blockage and resistance effects to the flow of air being circulated.

In conventional kilns of the type in which air is forced along a flow path that extends across finned pipes and through a charge of lumber for drying, the resistance to flow along the flow path that is caused by turns in the flow path and the finned pipes disadvantageously reduces the speed of the flow and the speed at which the charge can be dried. The reduction in the speed of the flow along the flow path can disadvantageously result in ununiform drying of the charge. The reduction in drying speed can be disadvantageous since mill production depends upon the ability to dry lumber at a sufficient rate so that production need not be slowed to allow for the drying process. The resistance to flow along the flow path also requires significant pressure increases to maintain the flow rate; therefore, the kiln fans, which force the heated air to flow along the flow path, must work excessively, which is disadvantageous. Operating the fans of a kiln consumes energy that adds to the cost of producing quality lumber. Of course it is advantageous to lower the cost of producing quality lumber. Whereas some conventional kilns can be characterized as being efficiently operated and able to dry lumber at a sufficient rate, there is always a demand for new kilns and kiln-related structures that can be even more efficiently operated, and that facilitate the drying of lumber at a sufficient rate.

SUMMARY OF THE INVENTION

The present invention solves the above and other problems by providing improved forced convection heat exchangers that can be used, for example, in kiln chambers.

More specifically and according to one aspect of the present invention, a kiln system has one or more air moving devices for circulating air along a flow path that passes across one or more pipe banks and through a charge of lumber that is positioned in the interior space of a kiln chamber. The pipe bank(s) are advantageously arranged for limiting the resistance to flow along the flow path, for promoting mixing of the air flowing along the flow path, and for functioning as guide vanes for contributing to the defining of one or more turns in the flow path.

In accordance with one aspect of the present invention, each pipe bank has multiple finned pipes that extend parallel to one another and through which a heated medium flows. Each pipe bank is positioned in the flow path so that air circulated by the air moving device(s) flows exteriorly across the finned pipes and heat is transferred from the finned pipes to the circulated air. Each finned pipe has an elongate portion having opposite ends and extending in a longitudinal direction between the opposite ends. The longitudinal direction is at least generally perpendicular to the portion of the flow path that is proximate the finned pipe.

In accordance with one aspect of the present invention, a minimum distance defined between a pipe bank and any of the finned pipes that are not part of the pipe bank is substantially greater than the minimum distance defined between adjacent finned pipes in the pipe bank in an end elevation view of the elongate portions of the finned pipes. In addition, the finned pipes of the pipe bank are arranged at least generally in a line in the end elevation view. Further, the pipe bank is arranged and any minimum distance defined between adjacent finned pipes of the pipe bank is sufficiently small in the end elevation view so that the pipe bank functions as a guide vane for contributing to the defining of a turn in the flow path, with the turn at least generally following the line defined by the finned pipes of the pipe bank in the end elevation view.

In accordance with one aspect of the present invention, the pipe banks are spaced apart from one another and arranged side by side with respect to one another so that at least a portion of the flow path extends between adjacent ones of the pipe banks. The minimum distance defined between the adjacent pipe banks is substantially greater than the minimum distance defined between adjacent finned pipes in the same pipe bank in the end elevation view of the elongate portions of the finned pipes. Adjacent pipe banks are arranged to cooperatively function as guide vanes for contributing to the defining of a turn in the flow path, with the turn at least generally following the lines that are defined by the arrangement of the finned pipes of the adjacent pipe banks in the end elevation view.

In accordance with one aspect of the present invention, the adjacent pipe banks are at approximately the same position along the flow path.

In accordance with one aspect of the present invention, each of the lines that are defined by the arrangement of the finned pipes in the end elevation view is at least generally straight. Alternatively, each of the lines that are defined by the arrangement of the finned pipes in the end elevation view is curved. More specifically, each of the pipe banks at least generally defines concave and convex shapes in the end elevation view, with the concave shapes at least generally facing the center of the chamber interior space.

In accordance with one aspect of the present invention, the minimum distance defined between the adjacent pipe banks is greater than approximately one half the length of the line defined by the arrangement of the finned pipes of either of the adjacent pipe banks in the end elevation view.

In accordance with one aspect of the present invention, the surface of each pipe bank is rough in the direction of flow along the flow path, so that a turbulent boundary layer is produced along the surface of each of the pipe banks. The turbulent boundary layer advantageously enhances mixing and convective heat transfer. Additionally, some of the flow that passes generally along the flow path passes between adjacent finned pipes of the same pipe bank, so that mixing and convective heat transfer are advantageously enhanced.

In accordance with one aspect of the present invention, one of the pipe banks of the adjacent pipe banks is longer than the other of the pipe banks of the adjacent pipe banks in the end elevation view.

In accordance with one aspect of the present invention, each of the finned pipes has a maximum outer diameter, and any minimum distance defined between adjacent finned pipes of the same pipe bank is less than approximately one half the maximum outer diameter. Additionally, the minimum distance defined between adjacent pipe banks is greater than approximately the maximum outer diameter.

In accordance with one aspect of the present invention, at least a first one of the pipe banks has a predetermined number of the finned pipes, each of the finned pipes of the first pipe bank has approximately the same maximum outer diameter, and the line defined by the arrangement of the finned pipes of the first pipe bank extends between the opposite ends of the first pipe bank in the end elevation view and has a length of approximately the product of the maximum outer diameter and the predetermined number. According to this aspect of the present invention, the minimum distance defined between the first pipe bank and the closest adjacent pipe bank is greater than approximately one half the length of the line that is defined by the arrangement of the finned pipes of the first pipe bank in the end elevation view.

In accordance with one aspect of the present invention, a partition is positioned in the kiln chamber and generally separates the chamber interior space into an upper portion that is positioned above the partition and a lower portion that is positioned below the partition. The lower portion of the chamber interior space is for receiving the charge of lumber for drying. The air moving device(s) are positioned in the upper portion of the chamber interior space and the flow path extends around the partition and through the upper and lower portions of the chamber interior space. The kiln chamber has structure that define the chamber interior space and the partition has opposite first and second edges that extend in the longitudinal direction and are spaced apart from the structure. A first gap that extends in the longitudinal direction is defined between the first edge of the partition and the structure. Similarly, a second gap that extends in the longitudinal direction is defined between the second edge of the partition and the structure. A single pipe bank or at least a first pair of adjacent pipe banks is positioned in the first gap, and/or a single pipe bank or at least a second pair of adjacent pipe banks is positioned in the second gap.

In accordance with one aspect of the present invention, the kiln chamber can be more generally characterized as a chamber or shell of a heat exchanger, and the finned pipes can be replaced with pipes, or the like, without fins, or the like. The shell-side medium is not limited to air. Additionally, the shell of the heat exchanger is not required to accommodate fans or other types of means for moving the shell-side medium. Likewise, the shell of the heat exchanger is not required to accommodate a charge of lumber or any other type of workpiece. However, the pipes are advantageously positioned in banks that are disposed at least generally as described above.

In accordance with one aspect of the present invention, the pipes or finned pipes are arranged to advantageously: promote mixing of the medium flowing externally to the pipes or finned pipes so that heat transfer is enhanced, function as one or more guide vanes for contributing to the turning of the flow path of the externally flowing medium, and limit the resistance to flow along the flow path, so that the velocity of the flow can be increased.

These and other aspects and advantages of the present invention will be apparent to those or ordinary skill in the art in view of this disclosure.

BRIEF DESCRIPTION OF THE DRAWINGS

Figure 1:
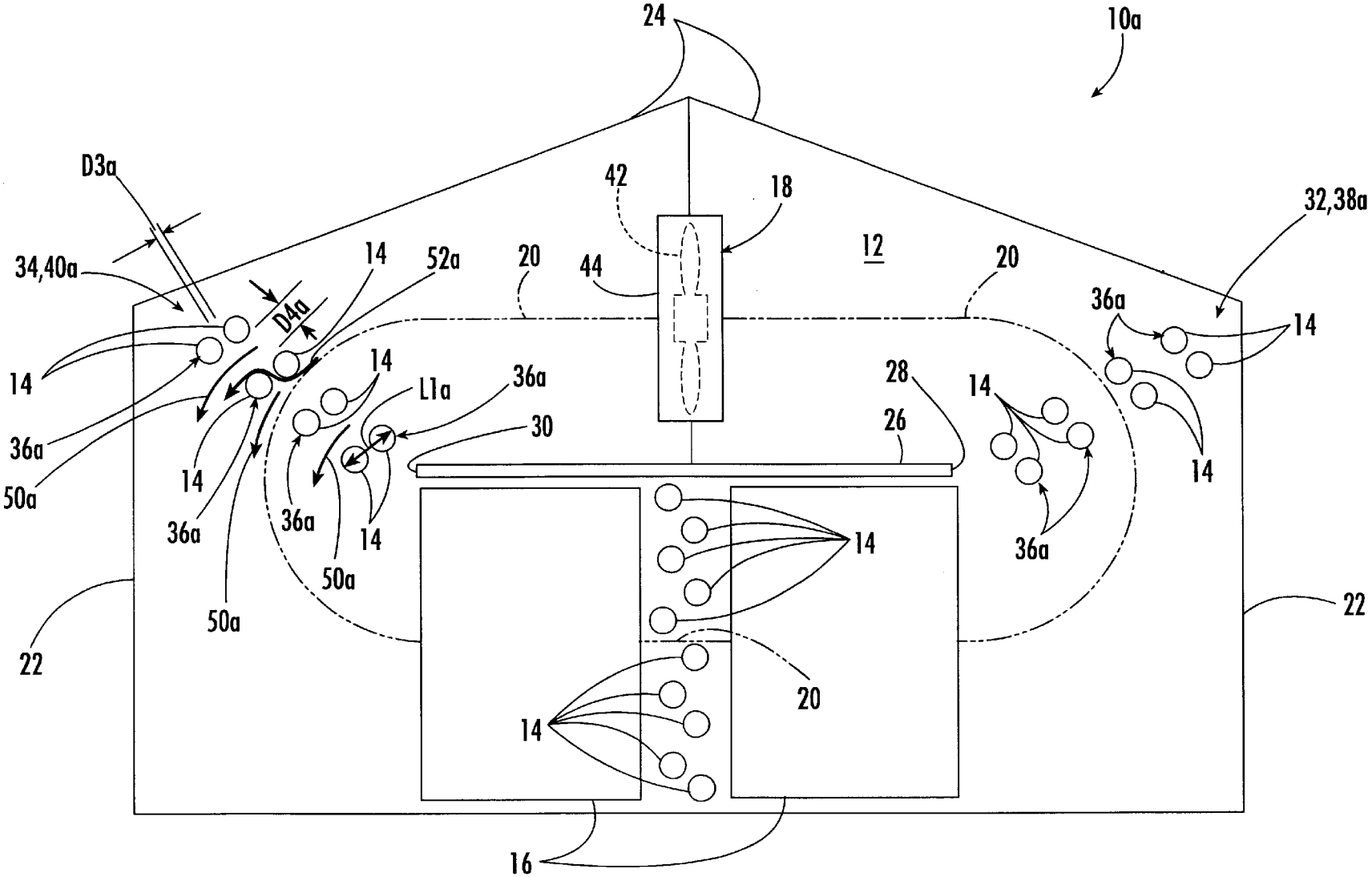
Figure 2:
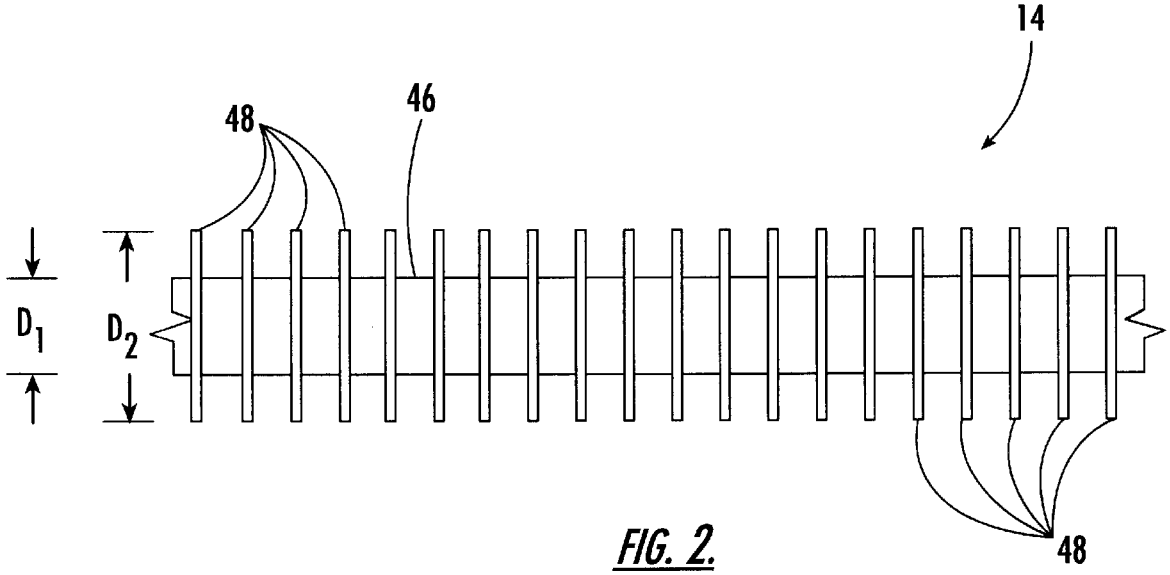
Figure 3:
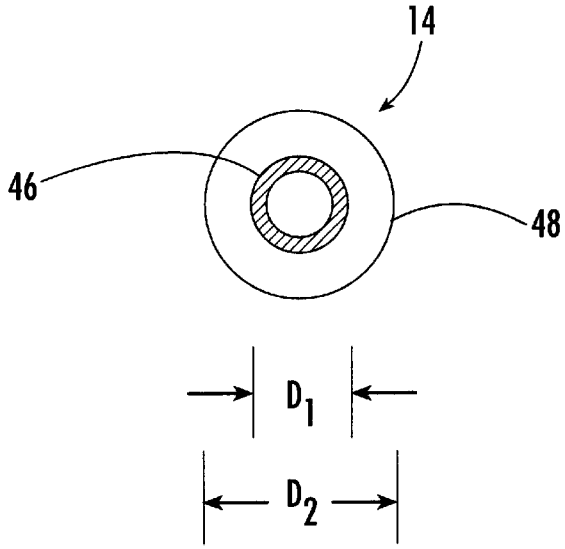
Figure 4:
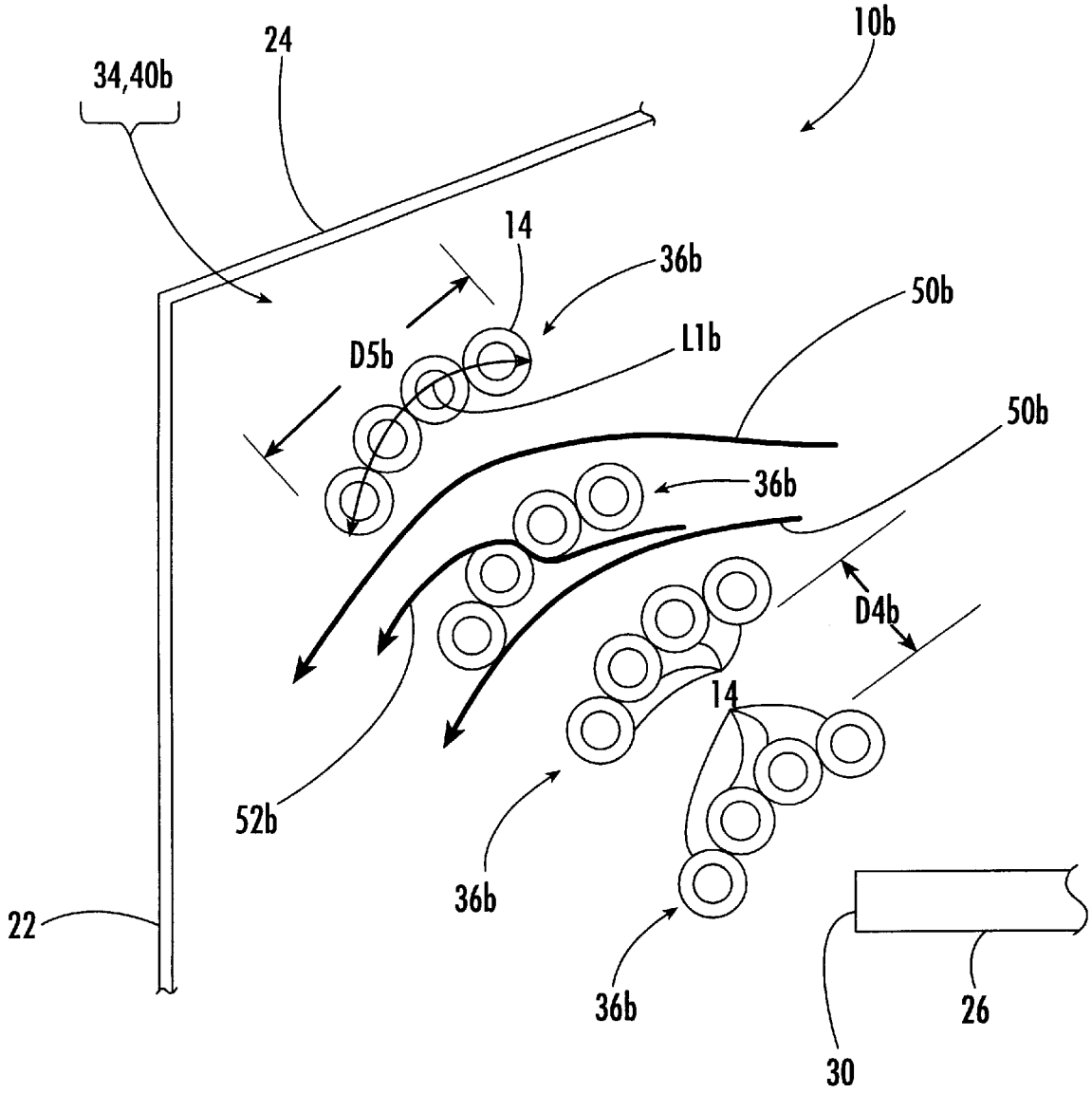
Figure 5:
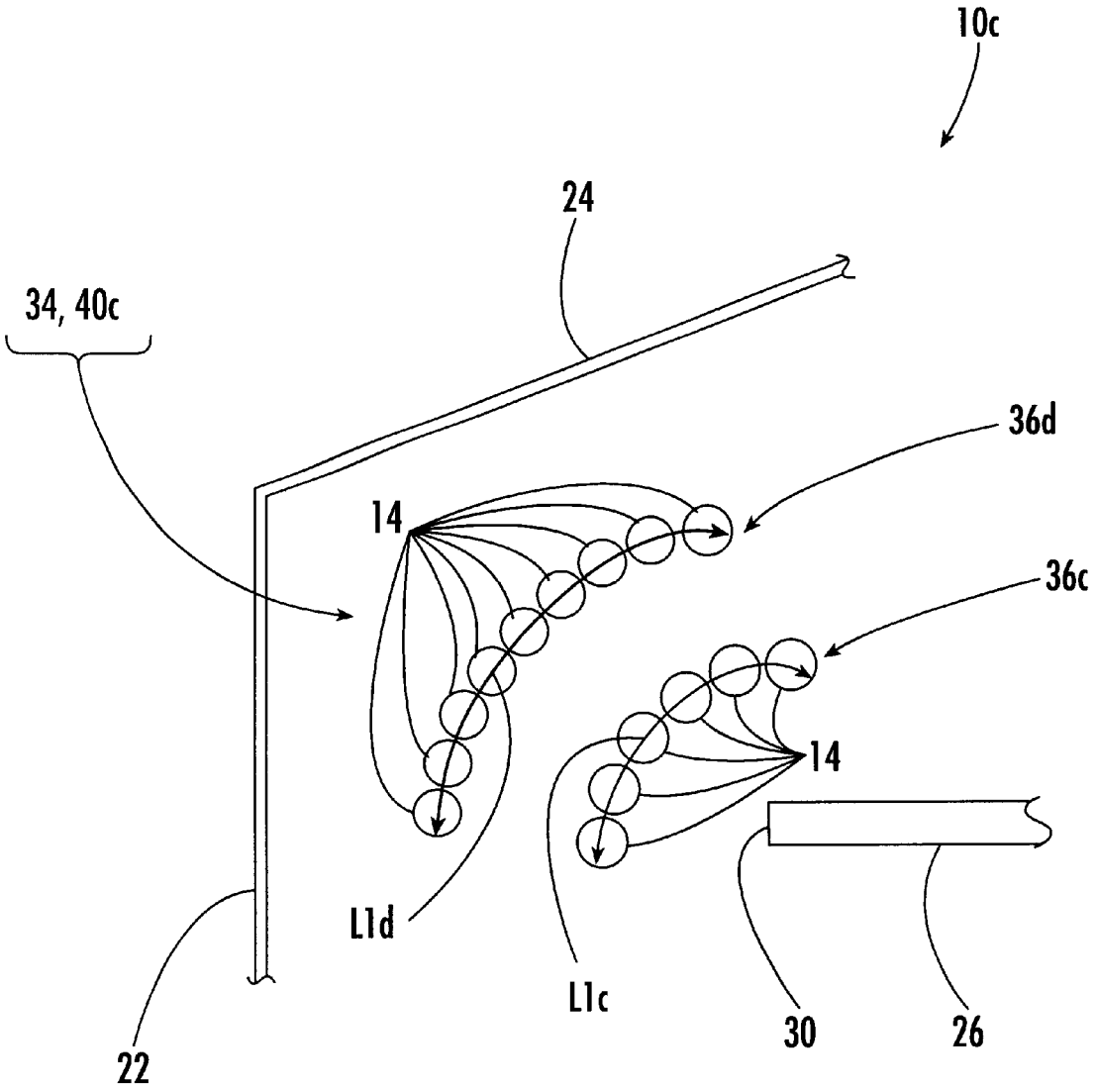
Figure 6:
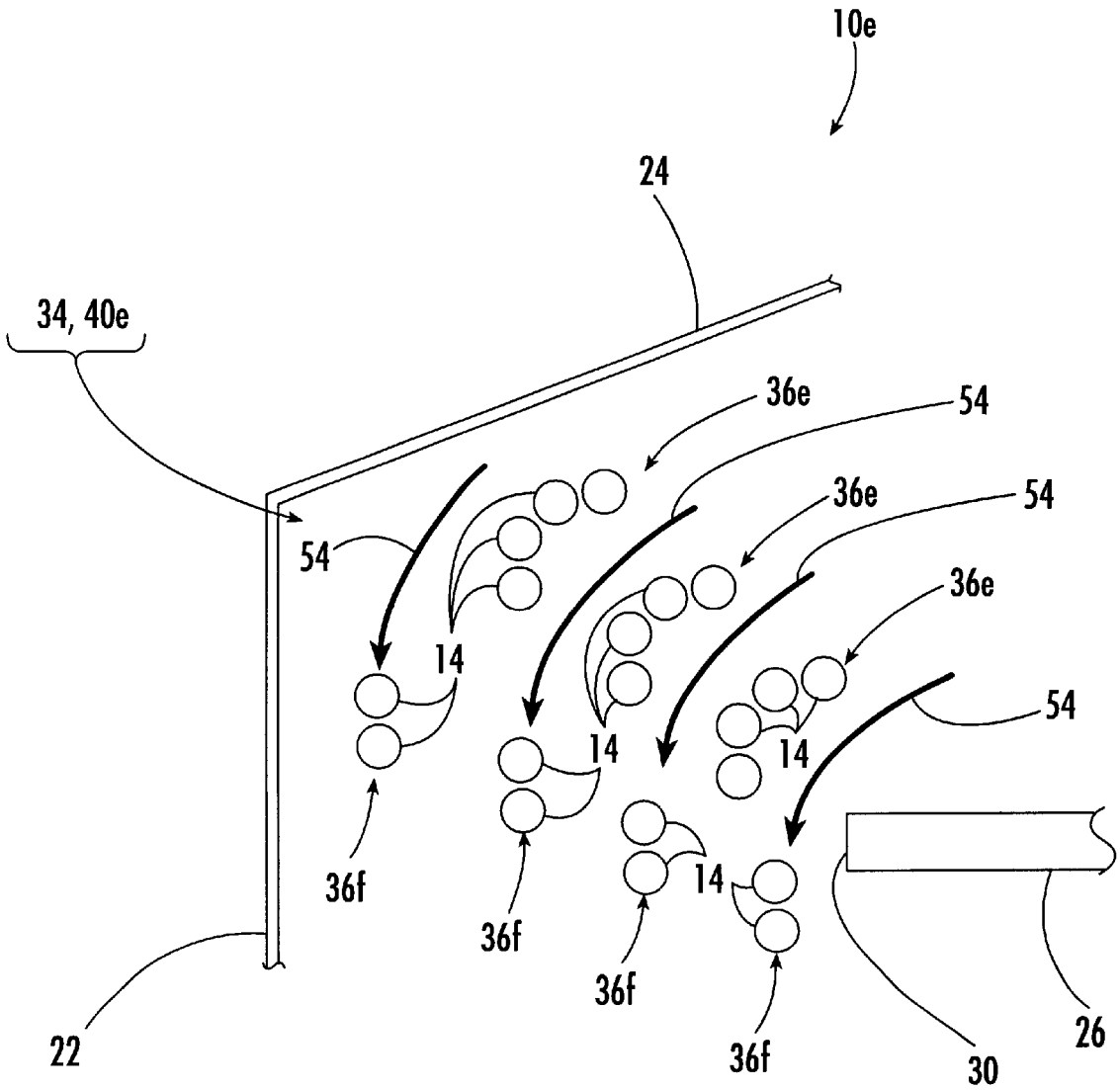

Having thus described aspects and advantages of the invention in general terms, reference will now be made to the accompanying drawings, which are not necessarily drawn to scale, and wherein:

FIG. 1 is a schematic cross-sectional view of a kiln chamber, with the cross-section taken in a vertical plane that is perpendicular to the length of finned pipes extending through the kiln chamber, in accordance with a first embodiment of the present invention;

FIG. 2 is an isolated side elevation view of a section of one of the finned pipes of the kiln chamber of FIG. 1;

FIG. 3 is an end elevation view of the section of finned pipe of FIG. 2;

FIG. 4 is a schematic cross-sectional view of a portion of a kiln chamber, with the cross-section taken in a vertical plane that is perpendicular to the length of finned pipes extending through the kiln chamber, in accordance with a second embodiment of the present invention;

FIG. 5 is a schematic cross-sectional view of a portion of a kiln chamber, with the cross-section taken in a vertical plane that is perpendicular to the length of finned pipes extending through the kiln chamber, in accordance with a third embodiment of the present invention; and FIG. 6 is a schematic cross-sectional view of a portion of a kiln chamber, with the cross-section taken in a vertical plane that is perpendicular to the length of finned pipes extending through the kiln chamber, in accordance with a fourth embodiment of the present invention.

DETAILED DESCRIPTION OF EXEMPLARY EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

A kiln chamber 10*a* of a kiln of a first embodiment of the present invention is schematically illustrated in FIG. 1, which is a vertical cross-sectional view taken perpendicular to a longitudinal direction that extends between a front end (not shown) and a rear end 12 of the kiln chamber. Usage herein of directional terms, such as front, rear, right and left, is for the purpose of clarifying this disclosure rather than for limiting the scope of the present invention. In accordance with the first embodiment, the kiln chamber 10*a* includes multiple finned pipes 14 with lengths that extend in the longitudinal direction; therefore, in FIG. 1 the cross-section is perpendicular to the lengths of the finned pipes. Accordingly, FIG. 1 can also be characterized as providing an end elevation view of elongate portions or sections of the finned pipes 14. In accordance with the first embodiment, the kiln chamber 10*a* is generally uniform along its length that extends in the longitudinal direction, and FIG. 1 is schematically illustrative of all possible vertical cross-sections taken perpendicular to the longitudinal direction.

The operation of the kiln of the first embodiment will initially be very generally described. The very general description will be followed by more detailed descriptions of structures, operations and advantages of the kiln of the first embodiment. The kiln chamber 10*a* has a chamber interior space that receives a charge of lumber 16 and through which the finned pipes 14 are extended. The kiln includes a conventional heating mechanism (not shown) for creating a heating medium. In accordance with the first embodiment, the heating mechanism is a steam boiler and the heating medium is steam. The heating medium flows through the finned pipes 14 so that the chamber interior space is heated. More specifically, the kiln of the first embodiment includes a communication system (not shown) that is generally conventional, except the manifolds of the communication system may not be conventional, as described below. The communication system is in a circuit with the steam boiler and the finned pipes 14 so that the heating medium flows from the boiler, through the finned pipes, and thereafter back to the boiler in a recirculating manner. In accordance with the first embodiment, it is preferred, but not required, for the communication system to include a control system and valves for controlling the flow of the heating medium with respect to the finned pipes 14.

Multiple air moving devices, such as a series of fans 18 (only one of which is shown) that extends in the longitudinal direction, are operated to circulate the air within the chamber interior space along a recirculating flow path 20. The general center of the recirculating flow path 20 is schematically illustrated in FIG. 1 by a line made up of a series of two short dashes alternating with one long dash. The air flowing along the flow path 20 is heated by the finned pipes 14 and dries the charge of lumber 16. The air flowing along the flow path 20 can be broadly characterized as a medium.

In accordance with the first embodiment, at least some of the finned pipes 14 are advantageously spaced apart to limit the resistance to flow along the flow path 20, and the finned pipes in the upper portion of the chamber interior space are additionally arranged to promote mixing of the air flowing along the flow path and to function as guide vanes for contributing to the turning of the flow path, which further contributes to limiting the resistance to flow along the flow path. Any reduction in heat transfer from the finned pipes 14 that is caused by the spaced apart arrangement of banks of the finned pipes is meaningfully offset by enhancements in heat transfer that result from increased flow rates that are achievable due to the reduction in the resistance to flow along the flow path 20 and the mixing provided by the arrangement of the finned pipes, as will be discussed in greater detail below.

More specifically regarding the kiln chamber 10*a,* it is conventional in all regards, except for the arrangement of the finned pipes 14 and variations closely associated therewith, which should be apparent to those of ordinary skill in the art in view of this disclosure. For example and in accordance with the first embodiment, the arrangement of pipe supports (not shown), such as pipe hangers, that hold the finned pipes 14 within the chamber interior space is not conventional; however, those of ordinary skill in the art will be able to provide the necessary supports in view of this disclosure. Similarly and in accordance with the first embodiment, the inlet and outlet manifolds respectively for supplying the heating medium to and receiving the heating medium from the finned pipes 14 may not be conventional; however, those of ordinary skill in the art will be able to provide the necessary manifolds in view of this disclosure.

Briefly described, the kiln chamber 10*a* includes generally upright wall structures 22 and roof structures 24 that cooperate to generally enclose the chamber interior space. In addition, a horizontally extending partition 26 that extends in the longitudinal direction is mounted within the chamber interior space and generally separates the chamber interior space into an upper portion that is positioned above the partition and a lower portion that is positioned below the partition.

The partition 26 includes opposite right and left sides or edges 28, 30 that extend in the longitudinal direction. A longitudinally extending right gap 32 is defined between the right edge 28 of the partition 26 and the wall and roof structures 22, 24 at the upper right corner of the kiln chamber 10*a*. Likewise, a longitudinally extending left gap 34 is defined between the left edge 30 of the partition 26 and wall and roof structures 22, 24 at the upper left comer of the kiln chamber 10*a*.

In accordance with the first embodiment, the finned pipes 14 proximate the upper portion of the chamber interior space are arranged in pipe banks 36*a* with each pipe bank including two finned pipes. An alternative embodiment is identical to the first embodiment, except that each pipe bank 36*a* includes three or more finned pipes 14. In accordance with the first embodiment, a right group 38*a* of pipe banks 36*a* is arranged in the right gap 32 to heat, mix and facilitate the turning of the air moving along the portion of the flow path 20 that extends through the right gap, as will be discussed in greater detail below. Likewise and in accordance with the first embodiment, a left group 40*a* of pipe banks 36*a* is arranged in the left gap 34 to heat, mix and facilitate the turning of the air moving along the portion of the flow path 20 that extends through the left gap, as will be discussed in greater detail below.

In accordance with the first embodiment, the right group 38*a* of pipe banks 36*a* are arranged side by side rather than end to end. Even more specifically and according to the illustrated example of first embodiment, it is preferred for each of the pipe banks 36*a* of the right group 38*a* to be at approximately the same position along the flow path 20. Similarly and in accordance with the first embodiment, the pipe banks 36*a* of the left group 40*a* are arranged side by side, and even more specifically they are preferably at approximately the same position along the flow path 20.

In accordance with the first embodiment, the fans 18 are positioned in the upper portion of the chamber interior space. Regarding the representative fan 18 illustrated in FIG. 1, it includes an impeller 42 that is circumferentially surrounded by a shroud 44. The impeller 42 is illustrated by broken lines in FIG. 1 because it is hidden from view by its shroud 44. The impeller 42 is driven in a conventional manner by a motor (not shown), as should be understood by those of ordinary skill in the art.

Some of the features of the kiln of the first embodiment of the present invention that are not shown in FIG. 1 will now be briefly described, and some of these features are disclosed in U.S. Pat. Nos. 5,414,944; 5,416,985; 5,437,109 and 5,488,785, and in U.S. patent application Ser. No. 09/538,177 filed on Mar. 30, 2000, and entitled Improved Reheaters for Kilns, Reheater-Like Structures, and Associated Methods, all of which are incorporated herein by reference. The kiln chamber 10*a* includes a front wall structure that defines one or more front door openings therethrough and carries front doors, typically in a pivotal or slideable fashion, that are used to open and close the front door opening(s). Similarly, the rear wall 12 defines one or more rear door openings therethrough and carries rear doors, also typically in a pivotal or slideable fashion, that that are used to open and close the rear door opening(s). The charge 16 can be respectively loaded into and removed from the kiln chamber 10*a* via the front and rear doors. It should be apparent, however, that the charge 16 can be loaded and unloaded through the same set of doors such that only one of the front and rear walls includes doors, or alternatively the doors could be in one or both side walls, if so desired.

A transportation system is provided for moving the charge 16 of lumber into the lower portion of the chamber interior space, such as through the front door opening(s), for drying, and thereafter out of the lower portion of the chamber interior space, such as through the rear door opening(s). The transportation system includes two sets of tracks upon which wheeled carriages travel. The tracks extend in the longitudinal direction across a slab that supports the kiln chamber 10*a*. The tracks extend through the lower portion of the chamber interior space, through the front door opening(s), and through the rear door opening(s). Each wheeled carriage carries a stack of lumber. Other transportation systems are also within the scope of the present invention.

The lower portion of the chamber interior space is for receiving the charge of lumber 16 for drying. In accordance with the first embodiment, the charge includes multiple stacks of lumber. However, the kiln is scaleable and in accordance with one embodiment of the present invention a smaller kiln is provided for which a charge includes a single stack of lumber. That is, kilns of various sizes are within the scope of the present invention. For example, kilns that are sufficiently small can include only a single fan and corresponding reduced numbers of other components.

Referring to FIG. 1 and regarding the finned pipes 14 more specially and in accordance with the first embodiment, the arrangement of the finned pipes in the left group 40*a* of pipe banks 36*a* is generally identical to and representative of the arrangement of the finned pipes in the right group 38*a* of pipe banks, except that the pipe banks in the right and left groups are oppositely oriented. In addition and within the left group 40*a* of pipe banks 36*a,* each of the pipe banks is generally representative of one another. Similarly, each of the finned pipes 14 are generally representative of one another.

Referring to FIGS. 2–3, a representative section of finned pipe 14 is shown. In isolation, each, of the finned pipes 14 is conventional and includes a conventional pipe 46 that is carries a series of conventional fins 48. Only a representative few of the fins 48 are specifically identified by their reference numeral in FIG. 2. As illustrated in FIGS. 2–3, the fins 48 are in the form of spaced apart flat rings that are mounted to and encircle the pipe 46. The fins can alternatively be in the form of a strip that extends radially from the pipe 46 and is helically wound around the pipe. Other types of finned pipe can also be used. Each finned pipe 14 defines a minor diameter D1 that is the outer diameter of its pipe 46, and a major diameter D2 that is the outer diameter of its fins 48. In accordance with the first embodiment, the minor diameter D1 is approximately one inch and the major diameter D2 is approximately four inches; however, a wide variety of differently sized finned pipes 14 are within the scope of the present invention. In FIG. 1, each of the finned pipes 14 is represented by a circle that represents the outer diameter D2 thereof.

Referring to FIG. 1 and the representative pipe bank 36*a* of the left group 40*a* that is most proximate the left edge 30 of the partition 26, its finned pipes 14 are arranged in tandem to at least generally define a straight line L1*a* that extends between the opposite ends of the pipe bank and through the centers of the finned pipes of the pipe bank. The line L1*a* is shown as a double ended arrow for illustrative purposes. The length of the line L1*a* is equal to the distance between the opposite ends of the representative pipe bank 36*a*. Referring to another representative one of the pipe banks 36*a* of the left group 40*a,* in accordance with the first embodiment, adjacent finned pipes 14 in the same pipe bank are slightly spaced apart from one another so that a minimum distance D3*a* is defined between adjacent finned pipes in the same pipe bank. Referring to a representative pair of adjacent pipe banks 36*a* of the left group 40*a,* in accordance with the first embodiment, a passage is defined between adjacent pipe banks such that a minimum distance D4*a* is defined between adjacent pipe banks. In accordance with the first embodiment, the length of the line L1*a* and the distances D3*a* and D4*a* are selected so as to enhance the operation of the kiln, as will be discussed in greater detail below.

The basic operation of the kiln of the first embodiment will now be described. The kiln chamber 10*a* is readied for operation by placing a charge 16 of green lumber within the lower portion of the chamber interior space in a conventional manner. Thereafter, the doors and other openings of the kiln chamber 10*a* are closed so that the chamber interior space is generally enclosed. Some leakage of air into and out of the chamber interior space is desired, however, so that moisture escapes from the chamber interior space and ambient air is drawn into the chamber interior space. After the chamber interior space is generally sealed with the charge 16 of green lumber in the lower portion of the chamber interior space, the boiler is operated in a conventional manner so that steam flows through at least some of, or all of, the finned pipes 14, and the fans 18 are operated to move the air within the chamber interior space along the flow path 20.

In accordance with the first embodiment, the direction of operation of the fans 18 is preferably periodically reversed while the charge 16 of lumber is being dried, which promotes uniform drying. More specifically, each fan 18 is operated in a manner that promotes clockwise flow along the flow path 20 during what can be characterized as a clockwise mode. Likewise, each fan 18 is operated in a manner that promotes counterclockwise flow along the flow path 20 during what can be characterized as a counterclockwise mode. In accordance with the first embodiment, the right and left groups 38*a,* 40*a* of pipe banks 36*a* each function advantageously in both the clockwise and counterclockwise operating modes. For purposes of this disclosure, FIG. 1 is the frame of reference for the counterclockwise and clockwise directions of flow along the flow path 20.

Examples of advantageous operating characteristics of the first embodiment of the present invention will now be described with reference to the left group 40*a* of pipe banks 36*a* and operation of the fans 18 in the counterclockwise mode. Because the right group 38*a* of pipe banks 36*a* is like, but oriented oppositely from, the left group 40*a* of pipe banks, the operation of the left group during the counterclockwise mode is representative of the operation of the right group during the clockwise mode.

Even without any finned pipes 14 or the like in the gaps 32, 34 respectively defined between the ends 28, 30 of the partition 26 and the upper interior right and left comer structures of the kiln chamber 10*a,* the flow path 20 would define turns in the right and left gaps 32, 34. As with any turns, the turns defined by the flow path 20 in the gaps 32, 34 cause flow-related losses, and conventional arrangements of finned pipes in the corresponding gaps of conventional kiln chambers compound the flow-related losses. In contrast and in accordance with the first embodiment of the present invention, the finned pipes 14 are arranged in the left gap 34 to advantageously limit the resistance to flow along the flow path 20. In addition and in accordance with the first embodiment, the finned pipes 14 in the left gap 34 are also arranged to advantageously promote mixing of the air flowing along the flow path 20, and to advantageously function as guide vanes for contributing to the turning of the flow path in the left gap 34, which advantageously further limits the resistance to flow along the flow path.

Referring to the representative left group 40*a* of pipe banks 36*a* in FIG. 1 and FIGS. 2–3, and in accordance with the first embodiment, the resistance to flow along the flow path 20 is advantageously limited because: the pipe banks are generally arranged in a series that extends generally perpendicular to the flow path 20, each of the pipe banks are oriented so that their centerlines (for example, see the line L1*a*) extend generally in the direction of flow along the flow path in the left gap 34 so that passages are defined between adjacent pipe banks, and the minimum distance D4*a* defined between the adjacent pipe banks is sufficiently large. Specifically and in accordance with the first embodiment, the distance D4*a* defined between the adjacent pipe banks is greater than approximately the major diameter D2. In accordance with the first embodiment, any reduction in heat transfer from the finned pipes 14 that is caused by the spaced apart arrangement of the pipe banks 36*a* is at least partially, and potentially significantly or completely, offset by enhancements in heat transfer that result from increased flow rates that are achievable due to the reduction in resistance to flow along the flow path 20 and the mixing provided by the pipe banks, as will be discussed in greater detail below.

In accordance with the first embodiment, the pipe banks 36*a* advantageously function as guide vanes because, in addition to the orientation of the centerlines (for example, see the line L1*a* of the pipe banks, the finned pipes 14 are arranged so that there is generally less resistance to flow passing through the passages defined between the adjacent pipe banks (for example, see the arrows 50*a* that illustrate flow through the passages defined between pipe banks) than there is with respect to flow passing through the space defined between the finned pipes of the same pipe bank (for example, see the arrow 52*a* that illustrates flow through a pipe bank). Accordingly and in accordance with the first embodiment, there is more flow passing through the passages defined between the adjacent pipe banks 36*a* (for example, see the arrows 50*a*) than there is passing through the spaces defined between the finned pipes of the same pipe bank (for example, see the arrow 52*a*). More specifically and in accordance with the first embodiment, the minimum distance D4*a* defined between adjacent pipe banks 36*a* is substantially greater than the minimum distance D3*a* defined between adjacent finned pipes 14 of the same pipe bank, and the distance D3*a* defined between adjacent finned pipes of the same pipe bank is less than approximately one half the major diameter D2 (FIGS. 2–3).

In accordance with the first embodiment, the pipe banks 36*a* advantageously cause some mixing simply by virtue of their being positioned in the flow path 20. This basic mixing is advantageously enhanced, in accordance with the first embodiment, because each pipe bank 36*a* has a generally rough surface and some of the flow passing generally along the flow path 20 passes between finned pipes 14 of the same pipe bank. More specifically and in accordance with the first embodiment, each finned pipe 14 is circular in cross-sections taken perpendicular to its length, so that the surface of each pipe bank 36*a* is very rough in the direction of flow along the flow path 20. As a result and advantageously, a very turbulent boundary layer is produced along the surface of each of the pipe banks 36*a*. For each pipe bank 36*a,* the turbulent boundary layer defines a length that corresponds generally to the length L1*a* of the pipe bank. The turbulent boundary layer enhances mixing and convective heat transfer. Also, because of the distance D3*a* defined between adjacent finned pipes 14 and because the surface of each finned pipe is defined at least partially by fins 48 (FIGS. 1–2), some of the flow that passes generally along the flow path 20 passes between adjacent finned pipes of the same pipe bank 36*a,* which advantageously further enhances mixing and convective heat transfer.

As mentioned briefly previously, the reduction in the blockage and the turning that is facilitated by the turning vane aspect of the present invention advantageously results in an increase in the velocity of the air flowing along the flow path 20 within the chamber interior space. The added velocity increases the heat transfer rate from the finned pipes 14. The above-discussed mixing also increases the heat transfer rate from the finned pipes 14. The result is that there will potentially be at least approximately the same amount of heat transfer from the finned pipes 14, but much less resistance to the flow along the flow path 20 and consequently a higher velocity of flow along the flow path 20. The higher velocity flow along the flow path 20 advantageously provides for faster and more uniform heat transfer within the charge 16.

Although the first embodiment is described in the context of a particular kiln, the present invention is not limited to the specifically described kiln. Even more generally, the present invention can be applied to any heat exchanger, or the like, in which flow that is flowing externally of banks of pipes, tubing, or the like, must change direction at a turn. Generally described and in accordance with one aspect of the present invention, the pipe, tubing, or the like, in the heat exchanger is arranged to serve both as a means of facilitating the heat transfer and to serve as one or more turning vanes. Whereas this is particularly applicable in kiln chambers where a flow of air is highly turbulent due to the use of fans to move the air along a flow path, it is also applicable to other types of heat exchanging arrangements. Accordingly, the present invention is not be limited to kilns or the specific kiln structures described herein.

An alternative embodiment of the present invention is identical to the first embodiment, except that each pipe bank 36*a* has pipes without fins rather than finned pipes 14, in which case the circles in FIG. 1 are representative of outer diameters of the pipes without fins. Another alternative embodiment of the present invention is identical to the first embodiment, except that in each of the pipe banks 36*a* adjacent finned pipes 14 are touching, as described below for a second embodiment of the present invention.

FIG. 4 illustrates a portion of a kiln chamber 10*b* in accordance with the second embodiment of the present invention. More specifically, FIG. 4 illustrates the left group 40*b* of pipe banks 36*b* of the second embodiment and portions of the wall 22 and roof structures 24 and partition 26 that are proximate the left group. The kiln of the second embodiment is identical to the kiln of the first embodiment, except for variations noted and variations that will be apparent to those of ordinary skill in the art in view of this disclosure.

In accordance with the second embodiment, each of the pipe banks 36*b* includes four finned pipes 14. In FIG. 4, each of the finned pipes 14 is represented by both an inner circle that represents the minor diameter D1 (FIGS. 2–3) of the finned pipe and an outer circle that represents the major diameter D2 (FIGS. 2–3) of the finned pipe, and only a representative few of the finned pipes 14 are specifically identified by their reference numeral. Referring to the upper most representative pipe bank 36*b* of the left group 40*b* of pipe banks in FIG. 4, its finned pipes 14 are arranged in tandem to at least generally define an arc-like curved centerline L1*b* that extends between the opposite ends of the pipe bank and through the centers of the finned pipes of the pipe bank. The line L1*b* is shown as a double ended arrow for illustrative purposes. More specifically and in accordance with the second embodiment, each pipe bank 36*b* at least generally defines concave and convex shapes, with the concave shapes at least generally facing the left edge 30 of the partition and the center of the chamber interior space. For each pipe bank 36*b,* this shape and orientation advantageously enhances the guide vane functionality that is described above.

In accordance with the second embodiment, the finned pipes 14 within a pipe bank 36*b* are at least approximately touching one another, and most preferably they are touching one another so that the length of the line L1*b* defined by the representative pipe bank is equal to approximately the product of the major diameter D2 (FIGS. 2–3) and the number of finned pipes in the pipe bank. As a result of the arcuate arrangement, the length of the line L1*b* is greater than a distance D5*b* defined between the opposite ends of the representative pipe bank.

Referring to a representative pair of adjacent pipe banks 36*b* in FIG. 4 and in accordance with the second embodiment, a minimum distance D4*b* is defined between the adjacent pipe banks. In accordance with one example of the second embodiment, the minimum distance D4*b* that is defined between the representative pair of adjacent pipe banks 36*b* is at least as great as approximately one half the length of the line L1*b* defined by one of the pipe banks of the representative pair of adjacent pipe banks. In accordance with other examples of the second embodiment, the distance D4*b* that is defined between the representative pair of adjacent pipe banks 36*b* is approximately one-half the length of or on the order of one half the length of the line L1*b* of one of the pipe banks of the representative pair of adjacent pipe banks.

Another alternative embodiment of the present invention is identical to the second embodiment, except that each pipe bank 36*b* has pipes without fins rather than finned pipes 14, in which case the outer circles in FIG. 4 are representative of outer diameters of the pipes without fins. In accordance with this alternative embodiment, for each of the pipe banks 36*b* the spacing between the finned pipes 14 thereof is preferably as described for the first embodiment. Another alternative embodiment of the present invention is identical to the second embodiment, except that for each of the pipe banks 36*b* the spacing between the finned pipes 14 thereof is as described for the first embodiment.

FIG. 5 illustrates a portion of a kiln chamber 10*c* in accordance with a third embodiment of the present invention. More specifically, FIG. 5 illustrates the left group 40*c* of pipe banks 36*c,* 36*d* of the third embodiment and portions of the wall and roof structures 22, 24 and partition 26 that are proximate the left group. The kiln of the third embodiment is identical to the kiln of the second embodiment, except for variations noted and variations that will be apparent to those of ordinary skill in the art in view of this disclosure. For example and in accordance with the third embodiment, the finned pipes 14 within the same pipe bank preferably touch one another as described for the second embodiment.

In accordance with the third embodiment, the inner pipe bank 36*c* of a pair of adjacent pipe banks 36*c,* 36*d* has a lesser number of finned pipes 14 than the outer pipe bank 36*d* of the pair. In FIG. 5, each of the finned pipes 14 is represented by a circle that represents the outer diameter D2 (FIGS. 2–3) thereof. Additionally, the centerline L1*c* that extends between the opposite ends of the inner pipe bank 36*c* and through the centers of the finned pipes 14 of the inner pipe bank is shorter than the centerline L1*d* that extends between the opposite ends of the outer pipe bank 36*d* and through the centers of the finned pipes of the outer pipe bank.

Another alternative embodiment of the present invention is identical to the third embodiment, except for each of the pipe banks 36*c,* 36*d* the spacing between the finned pipes 14 thereof is as described for the first embodiment. Another alternative embodiment of the present invention is identical to the third embodiment, except that each pipe bank 36*c,* 36*d* has pipes without fins rather than finned pipes 14, in which case the circles in FIG. 5 are representative of outer diameters of the pipes without fins. In accordance with this alternative embodiment, for each of the pipe banks 36*c,* 36*d* the spacing between the finned pipes 14 thereof is preferably as described for the first embodiment.

FIG. 6 illustrates a portion of a kiln chamber 10*e* in accordance with a fourth embodiment of the present invention. More specifically, FIG. 6 illustrates the left group 40*e* of pipe banks 36*e,* 36*f* of the fourth embodiment and portions of the wall and roof structures 22, 24 and partition 26 that are proximate the left group. The kiln of the fourth embodiment is identical to the kiln of the second embodiment, except for variations noted and variations that will be apparent to those of ordinary skill in the art in view of this disclosure. For example and in accordance with the fourth embodiment, the finned pipes 14 within the same pipe bank preferably touch one another as described for the fourth embodiment.

In FIG. 6, each of the finned pipes 24 is represented by a circle that represents the outer diameter D2 (FIGS. 2–3) thereof. Only a representative few of the finned pipes are specifically identified by their reference numeral in FIG. 6.

In accordance with the fourth embodiment, the left group 40*e* includes upper pipe banks 36*e* that are arranged side by side, or more specifically they are at approximately the same position along the flow path 20 (FIG. 1); and the left group 40*e* further includes lower pipe banks 36*f* that are arranged side by side, or more specifically they are at approximately the same position along the flow path. The upper pipe banks 36*e* are arranged to direct the flow to the lower pipe banks 36*f,* as generally indicated by the arrows 54. The lower banks 36*f* are, in this embodiment, intended to direct the flow along a straight line rather than a curved path.

Another alternative embodiment of the present invention is identical to the fourth embodiment, except for each of the pipe banks 36*e,* 36*f* the spacing between the fined pipes 14 thereof is as described for the first embodiment. Another alternative embodiment of the present invention is identical to the fourth embodiment, except that each pipe bank 36*e*, 36*f* has pipes without fins rather than fined pipes 14, in which case the circles in FIG. 6 are representative of outer diameters of the pipes without fins. In this alternative embodiment, for each of the pipe banks 36*e*, 36*f* the spacing between the finned pipes 14 thereof is preferably as described for the first embodiment.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A kiln system for drying a charge of lumber, the kiln system comprising:

a kiln chamber defining a chamber interior space for receiving the charge of lumber for drying;

an air moving device for circulating air in the chamber interior space along a flow path; and a plurality of pipe banks positioned in the chamber interior space, wherein:

each pipe bank comprises a plurality of finned pipes for having a heated medium flow interiorly therethrough, and each pipe bank is positioned in the flow path so that air circulated by the air moving device flows exteriorly across the finned pipes, whereby heat is transferred from the finned pipes to the air circulated by the air moving device, each finned pipe comprises an elongate portion having opposite ends and extending in a longitudinal direction between the opposite ends, with the longitudinal direction being at least generally perpendicular to the portion of the flow path that is proximate the finned pipe, the pipe banks are spaced apart from one another and arranged side by side with respect to one another so that at least a portion of the flow path extends between adjacent ones of the pipe banks, the minimum distance defined between the adjacent pipe banks is substantially greater than the minimum distance defined between adjacent finned pipes in the same pipe bank in an end elevation view of the elongate portions of the finned pipes, and for each pipe bank, its finned pipes are arranged at least generally in a line in the end elevation view, and the pipe bank is arranged and any minimum distance defined between adjacent finned pipes of the pipe bank is sufficiently small in the end elevation view so that the adjacent pipe banks function as guide vanes for contributing to the defining of a turn in the flow path, with the turn at least generally following the lines that are defined by the arrangement of the finned pipes in the end elevation view.

2. A kiln system according to claim 1, wherein the adjacent pipe banks are at approximately the same position along the flow path.

3. A kiln system according to claim 1, wherein each of the lines that are defined by the arrangement of the finned pipes in the end elevation view is at least generally straight.

4. A kiln system according to claim 1, wherein each of the lines that are defined by the arrangement of the finned pipes in the end elevation view is curved.

5. A kiln system according to claim 1, wherein each of the pipe banks at least generally defines concave and convex shapes in the end elevation view, with the concave shapes at least generally facing the center of the chamber interior space.

6. A kiln system according to claim 1, wherein the minimum distance defined between the adjacent pipe banks is greater than approximately one half the length of the line defined by the arrangement of the finned pipes of either of the adjacent pipe banks in the end elevation view.

7. A kiln system according to claim 1, wherein the surface of each pipe bank is rough in the direction of flow along the flow path, whereby a turbulent boundary layer is produced along the surface of each of the pipe banks that enhances mixing and convective heat transfer.

8. A kiln system according to claim 1, wherein the pipe banks are arranged so that some of the flow that passes generally along the flow path passes between adjacent finned pipes of the same pipe bank, whereby mixing and convective heat transfer are enhanced.

9. A kiln system according to claim 1, wherein one of the pipe banks of the adjacent pipe banks is longer than the other of the pipe banks of the adjacent pipe banks in the end elevation view.

10. A kiln system according to claim 1, wherein each of the finned pipes has a maximum outer diameter, and any minimum distance defined between adjacent finned pipes of the same pipe bank is less than approximately one half the maximum outer diameter.

11. A kiln system according to claim 10, wherein the minimum distance defined between adjacent pipe banks is greater than approximately the maximum outer diameter.

12. A kiln system according to claim 1, wherein at least a first of the pipe banks comprises a predetermined number of the finned pipes, each of the finned pipes of the first pipe bank has approximately the same maximum outer diameter, and the line defined by the arrangement of the finned pipes of the first pipe bank extends between the opposite ends of the first pipe bank in the end elevation view and has a length of approximately the product of the maximum outer diameter and the predetermined number.

13. A kiln system according to claim 12, wherein the minimum distance defined between the first pipe bank and the closest adjacent pipe bank is greater than approximately one half the length of the line that is defined by the arrangement of the finned pipes of the first pipe bank in the end elevation view.

14. A kiln system according to claim 1, further comprising a partition positioned in the kiln chamber and generally separating the chamber interior space into an upper portion that is positioned above the partition and a lower portion that is positioned below the partition and is capable of receiving the charge of lumber for drying, wherein the air moving device is positioned in the upper portion of the chamber interior space and the flow path extends around the partition and through the upper and lower portions of the chamber interior space.

15. A kiln system according to claim 14, wherein the kiln chamber comprises structure that defines the chamber interior space and the partition comprises opposite first and second edges that extend in the longitudinal direction and are spaced apart from the structure so that a first gap that extends in the longitudinal direction is defined between the first edge and the structure and a second gap that extends in the longitudinal direction is defined between the second edge and the structure, a first pair of adjacent pipe banks is positioned in the first gap, and a second pair of adjacent pipe banks is positioned in the second gap.

16. A kiln system according to claim 15, wherein the first and second pairs of pipe banks at least generally define concave and convex shapes in the end elevation view, with the concave shapes of the first pair of pipe banks facing the first edge of the partition, and the concave shapes of the second pair of pipe banks facing the second edge of the partition.

17. A kiln system for drying a charge of lumber, the kiln system comprising:

a kiln chamber defining a chamber interior space for receiving the charge of lumber for drying;

an air moving device for circulating air in the chamber interior space along a flow path; and a plurality of finned pipes positioned in the chamber interior space and for having a heated medium flow interiorly therethrough and positioned in the flow path so that air circulated by the air moving device flows exteriorly across the finned pipes, whereby heat is transferred from the finned pipes to the air circulated by the air moving device, wherein:

each finned pipe comprises an elongate portion having opposite ends and extending in a longitudinal direction between the opposite ends, with the longitudinal direction being at least generally perpendicular to the portion of the flow path that is proximate the finned pipe, a subset of the finned pipes defines a pipe bank, the minimum distance defined between the pipe bank and any of the finned pipes that are not part of the pipe bank is substantially greater than the minimum distance defined between adjacent finned pipes in the pipe bank in an end elevation view of the elongate portions of the finned pipe, the finned pipes of the pipe bank are arranged at least generally in a line in the end elevation view, and the pipe bank is arranged and any minimum distance defined between adjacent finned pipes of the pipe bank is sufficiently small in the end elevation view so that the pipe bank functions as a guide vane for contributing to the defining of a turn in the flow path, with the turn at least generally following the line defined by the finned pipes of the pipe bank in the end elevation view.

18. A kiln system according to claim 17, wherein the line that is defined by the arrangement of the finned pipes in the end elevation view is at least generally straight.

19. A kiln system according to claim 17, wherein the line that is defined by the arrangement of the finned pipes in the end elevation view is curved.

20. A kiln system according to claim 17, wherein the pipe bank at least generally defines concave and convex shapes in the end elevation view, with the concave shape at least generally facing the center of the chamber interior space.

21. A kiln system according to claim 17, wherein the surface of the pipe bank is rough in the direction of flow along the flow path, whereby a turbulent boundary layer is produced along the surface of the pipe bank that enhances mixing and convective heat transfer.

22. A kiln system according to claim 17, wherein some of the flow that passes generally along the flow path passes between adjacent finned pipes of the pipe bank, whereby mixing and convective heat transfer are enhanced.

23. A kiln system according to claim 17, wherein the pipe bank comprises a predetermined number of the finned pipes, each of the finned pipes of the pipe bank has approximately the same maximum outer diameter, and the line defined by the arrangement of the finned pipes of the pipe bank extends between the opposite ends of the pipe bank in the end elevation view and has a length of approximately the product of the maximum outer diameter and the predetermined number.

24. A kiln system according to claim 17, further comprising a partition positioned in the kiln chamber and generally separating the chamber interior space into an upper portion that is positioned above the partition and a lower portion that is positioned below the partition and is capable of receiving the charge of lumber for drying, wherein the air moving device is positioned in the upper portion of the chamber interior space and the flow path extends around the partition and through the upper and lower portions of the chamber interior space, and wherein the kiln chamber comprises structure that define the chamber interior space and the partition comprises opposite first and second edges that extend in the longitudinal direction and are spaced apart from the structure so that a first gap that extends in the longitudinal direction is defined between the first edge and the structure and a second gap that extends in the longitudinal direction is defined between the second edge and the structure, and the pipe bank is positioned in the first gap.

* * * * *